US005671809A

United States Patent [19]

McKinzie

[11] Patent Number: 5,671,809

[45] Date of Patent: Sep. 30, 1997

[54] METHOD TO ACHIEVE LOW COST ZONAL ISOLATION IN AN OPEN HOLE COMPLETION

[75] Inventor: Howard Lee McKinzie, Sugar Land, Tex.

[73] Assignee: Texaco Inc., White Plains, N.Y.

[21] Appl. No.: 591,816

[22] Filed: Jan. 25, 1996

[51] Int. Cl.[6] ..... E21B 33/124; E21B 33/13

[52] U.S. Cl. ..... 166/285; 166/147; 166/191

[58] Field of Search ..... 166/147, 191, 166/285, 287, 289, 293, 295

[56] References Cited

U.S. PATENT DOCUMENTS

| | | | |
|---|---|---|---|
| 2,187,493 | 1/1940 | Baker | 166/289 X |
| 4,655,286 | 4/1987 | Wood | 166/289 X |
| 4,913,232 | 4/1990 | Cheymol et al. | 166/285 |
| 5,028,344 | 7/1991 | Hoskin | 166/285 X |
| 5,507,345 | 4/1996 | Wehunt, Jr. et al. | 166/285 |

*Primary Examiner*—David J. Bagnell

*Attorney, Agent, or Firm*—Henry H. Gibson; William J. Beard

[57] ABSTRACT

A low cost zonal isolation technique for use in open hole well completions and workovers is disclosed. A production liner, tubing string, casing string or coiled tubing is provided with spaced apart pairs of sealing means having at least one hole drilled through the liner between each pair. The liner or other tubular is run in and placed across the production interval. Cement, resin or polymer gel is pumped into the annular between the liner and borehole wall through each of the holes between the liner and borehole wall through each of the holes between pairs of seals and allowed to harden or set up. The bore of the production liner is then drilled out and the production interval completed for well production or workovers, as desired.

5 Claims, 1 Drawing Sheet

METHOD TO ACHIEVE LOW COST ZONAL ISOLATION IN AN OPEN HOLE COMPLETION

BACKGROUND OF THE INVENTION

The present invention relates to a method of achieving zonal isolation in open hole well completions. Some type of elastomeric or rubberized zone seals are used along with a consolidation material such as cement, resin or the like to simultaneously attain zonal isolation in several zones.

In my prior U.S. Pat. No. 5,339,901 a method for achieving zonal isolation at low cost was disclosed. This technique involved the use of a specialized piece of hardware spanning the zones desired to be isolated. This specialized piece of hardware contained a reverse flow channel located exteriorly of the tubing string used to deliver the consolidation material to the completion interval and the completion liner. This established a separate flow channel on the outside of the liner used in the completion interval which was in addition to the annular space normally present between the liner and the wall of the well borehole. The present invention is an improvement over this technique in which the use of the specialized exterior reverse flow channel is eliminated.

Numerous techniques have been developed for zonal isolation in open hole completions. Most of these techniques are prohibitively expensive and notoriously unreliable. Techniques such as the use of diverting agents and pills are often used, but these are difficult to remove and may cause damage to producing zones.

An open hole completion can mean any well completion without any tubulars, or with a slotted liner, a preperforated liner, etc. and with or without a gravel pack. Open hole completions are often not used because of the difficulty encountered when trying to work over or clean out the completion at a later time. Sand productivity, near wellbore formation damage, or the need to fracture or acidize would all be reasons to later work over an open hole completion. Most of these operations require that certain zones within the production interval be treated individually. This is not normally possible in long open hole completions because it may be necessary to isolate small sections of the production zone in order to treat the entire production zone effectively. This can be the case especially in horizontal portions of a well.

BRIEF DESCRIPTION OF THE INVENTION

In the technique of the present invention a liner (which could also be a tubing string, a casing string or a section of coiled tubing to be used for the completion) is run in on a tubing string into the open hole production zone. The liner spans the entire production zone. Centralizers are used to affix the liner centrally in the production zone.

Opposed cup washers or other elastomeric or rubberized devices are placed towards the ends of each zonal section of liner to be sealed to form a temporary seal between the liner and the gauge hole (borehole). Before assembling and running in or placing the liner, at least one (and more if desired) holes are drilled in the liner between each opposed pair of seals or between the last seal and the end of the liner. It should also be mentioned that other techniques such as perforating a casing string or tubing string could be used. Only one such hole in the liner is required in each zone it is desired to isolate over the production interval, but more may be placed if desired. The prepared liner is run into the borehole and placed in the production zone or interval. Resin, cement, or polymer as desired in the completion is then pumped down the tubing string and out of the drilled holes between the seals into the annular space between the seals, completely filling each annular space between the temporary seals. If resin is used an excess of resin can be placed by squeezing some of the resin into the near borehole formations thereby effecting a better seal. The cement, resin or polymer is allowed to set. Then the liner is drilled out, removing the excess resin or cement or polymer. The remainder of the annular space about each section of liner is left open. The liner may then be perforated, if desired, or a slotted or preperforated liner could have been used if desired. In the latter instance, of course, another tubing string or a coiled tubing with appropriate sealing elements would be used to deliver the resin, cement or polymer.

The invention may best be understood by the following detailed description when taken in conjunction with the accompanying drawings.

BRIEF DESCRIPTION THE DRAWINGS

FIG. 1 is a schematic diagram of a producing interval showing zonal isolation according to concepts the present invention. FIG. 1A shows the placed prepared liner before resin, cement, or polymer placement. FIG. 1B of the figure shows the same interval after cement, resin, or polymer placement and drilling out.

DESCRIPTION OF THE PREFERRED EMBODIMENT

Figure 1A:
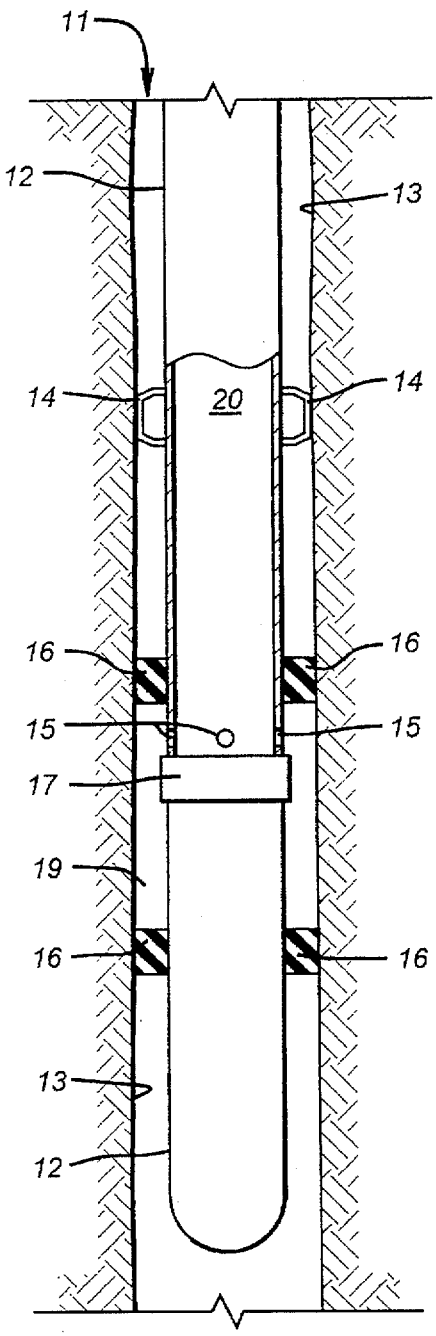
Figure 1B:
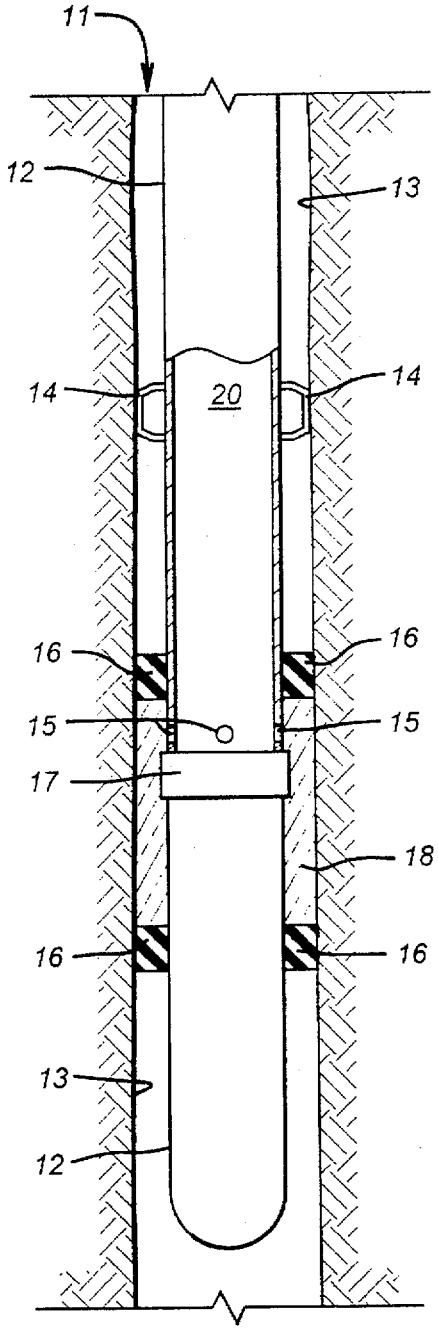

Referring now to the left portion of FIG. 1 a well borehole 11, having a wall 13 is shown with a prepared production liner 12 in place therein. Centralizers 14 are used to align the liner 12 in place near the center of borehole 11 and are necessary if the hole is near horizontal, rather than vertical as shown here, for this purpose. The production liner 12 may be pre-perforated or slotted or may be any conventional type of open hole completion liner as desired.

A pair of temporary seals such as opposed rubberized or elastomeric cup washers 16 is placed across an interval of the liner 12, having a connection joint 17 therein, to form an annulus 19 between the liner 12 and the borehole wall 13 of the open hole production interval. It is desired to place a more permanent seal between opposed rubberized cup washers 16 in the annulus 19 formed between the liner 12 and the borehole wall 13. To this end a hole 15 is predrilled or perforated into the wall of the liner 12 between the rubberized opposed cup washer seals 16 to allow the placement of cement or resin from the interior bore of the liner. While only one such hole 15 is shown, it will be understood that as many as desired could be placed in the wall of the liner 12 between the cup washer end seals 16.

Referring now to the right portion of the FIG. 1, the same interval of the production zone is shown after placement of the resin or cement material and drilling out the liner. In practice, the prepared liner 12 is run into the borehole 11 on a string of tubing. The cement, resin, or polymer is pumped down the tubing string (not shown) and into the liner 12. Thus the resin, cement or polymer sealer is forced out of holes 15 between each pair of cup washer seals 16 as desired. While only one pair of seals 16 are shown, it will be understood that more pairs of seals 16 could be used across zones it is desired to isolate in the production interval if desired.

When the resin or cement is forced out into the annulus 19 and allowed time to harden, cure or set up, a resin or cement plug 18 is formed in the annulus 19 across each of the desired isolation zones. The liner 12 bore 20 is then opened up for fluid production by drilling out any cement or resin from its interior bore 20.

Once the zonal isolation has been achieved, any desired completion or workover techniques for open hole may be used such as perforating the liner, placing gravel packs, acidizing or fracturing, etc. The seals or plugs 18 between seals 16 isolate vertical or horizontal zones within the production interval from each other due to fluid contact or communication along the borehole 12.

The above descriptions may make other changes and modifications apparent to those of skill in the art. It is the aim of the appended claims to cover all such changes and modifications as fall within the true spirit and scope of the invention.

I claim:

1. A method for achieving zonal isolation across a production interval in an open hole completed well, comprising the steps of:

a) providing a production liner having a generally cylindrical shape with a wall defining a bore therein and having a length capable of spanning the production interval and having at least one shorter length isolation zone defined therein by a pair of temporary sealing means disposed longitudinally apart on the exterior surface of said liner, said liner also having separate centralizer means to centralize it in a well borehole and being adapted to be run into a production interval on the end of a production tubing string;

b) providing at least one hole in the wall of said production liner from the bore thereof to the exterior thereof and located in the longitudinal interval between said temporary sealing means;

c) running said production liner into the borehole on the end of a production tubing string and placing it over the entire length of said production interval;

d) pumping a fluid sealing means down said production tubing string and into said liner and forcing it out of said at least one hole in said wall of said liner to fill the annular interval between said temporary sealing means with said fluid sealing means;

e) allowing said fluid sealing means to cure or harden in place;

f) drilling out said bore in said liner to remove all excess fluid sealing means remaining therein and to clear said bore for production fluids; and g) completing the well for production across the production interval.

2. The method of claim 1 wherein said step of pumping a fluid sealing means comprises pumping cement.

3. The method of claim 1 wherein said step of pumping a fluid sealing means comprises pumping a consolidatable resin.

4. The method of claim 1 wherein said step of pumping a fluid sealing means comprises pumping a polymer gel.

5. The method of claim 1 wherein the steps referring to a production liner are performed with a coil tubing string rather than a production liner.

* * * * *